US007785426B2

(12) United States Patent
Tabuchi et al.

(10) Patent No.: US 7,785,426 B2
(45) Date of Patent: Aug. 31, 2010

(54) WELDED JOINT OF TEMPERED MARTENSITE BASED HEAT-RESISTANT STEEL

(75) Inventors: Masaaki Tabuchi, Tsukuba (JP); Hirokazu Okada, Tsukuba (JP); Masayuki Kondo, Tsukuba (JP); Susumu Tsukamoto, Tsukuba (JP); Fujio Abe, Tsukuba (JP)

(73) Assignees: National Institute for Materials Science, Ibaraki (JP); Sumitomo Metal Industries, Ltd., Osaka (JP); Mitsubishi Heavy Industries, Ltd., Tokyo (JP)

( * ) Notice: Subject to any disclaimer, the term of this patent is extended or adjusted under 35 U.S.C. 154(b) by 426 days.

(21) Appl. No.: 10/551,222

(22) PCT Filed: Mar. 31, 2004

(86) PCT No.: PCT/JP2004/004599

§ 371 (c)(1),
(2), (4) Date: Jun. 21, 2006

(87) PCT Pub. No.: WO2004/087979

PCT Pub. Date: Oct. 14, 2004

(65) Prior Publication Data

US 2006/0237103 A1 Oct. 26, 2006

(30) Foreign Application Priority Data

Mar. 31, 2003 (JP) ..... 2003-095742

(51) Int. Cl.
*C22C 38/32* (2006.01)
*C22C 38/24* (2006.01)
*C22C 38/26* (2006.01)

(52) U.S. Cl. ..... 148/325; 148/334; 420/64; 420/69; 420/37

(58) Field of Classification Search ..... 148/325, 148/334; 420/34, 64, 37, 69

See application file for complete search history.

(56) References Cited

U.S. PATENT DOCUMENTS

| | | | | |
|---|---|---|---|---|
| 2,586,042 | A * | 2/1952 | Hodge et al. | 420/91 |
| 4,477,280 | A * | 10/1984 | Shiga et al. | 420/69 |
| 5,415,706 | A * | 5/1995 | Scarlin et al. | 148/325 |
| 5,591,391 | A * | 1/1997 | Igarashi et al. | 420/38 |
| 5,650,024 | A * | 7/1997 | Hasegawa et al. | 148/326 |
| 7,128,791 | B2 * | 10/2006 | Horiuchi et al. | 148/325 |

FOREIGN PATENT DOCUMENTS

| | | |
|---|---|---|
| JP | 2001-192761 | 7/2001 |
| JP | 2001-279391 | 10/2001 |
| JP | 2002-69588 | 3/2002 |

* cited by examiner

*Primary Examiner*—Deborah Yee
(74) *Attorney, Agent, or Firm*—Wenderoth, Lind & Ponack, L.L.P.

(57) ABSTRACT

A welded joint of a tempered martensitic heat resisting steel includes a fine-grained heat affected zone of weldment of a heat resisting steel having a tempered martensite structure which exhibits a creep strength of 90% or more of the creep strength of the base metal thereof. The welded joint is inhibited in the formation of the fine-grained HAZ exhibiting a significantly reduced creep strength.

2 Claims, 2 Drawing Sheets

WELDED JOINT OF TEMPERED MARTENSITE BASED HEAT-RESISTANT STEEL

TECHNICAL FIELD

The present invention relates to a welded joint of a tempered martensitic heat resisting steel. More particularly, the present invention relates to a welded joint of a tempered martensitic heat resisting steel in which formation of fine-grained HAZ causing remarkable decrease in creep strength is suppressed.

BACKGROUND ART

A tempered martensitic heat resisting steel has, as represented by ASME T91, P92, P122, excellent high temperature creep strength, and is used in heat resistance and pressure resistant components of a high temperature plant typically including a thermal power plant and atomic power plant. In many cases, however, pressure resistant components and pressure resistant parts of a tempered martensitic heat resisting steel in a high temperature plant are manufactured by welding, and a weldment has a different structure from that of the base metal, consequently, its creep strength becomes lower than that of the base metal. Therefore, the creep strength of a weldment part is an important factor for the performance of a high temperature plant.

The welding procedure used for heat and pressure resistant components in a high temperature plant includes TIG welding, shielded metal arc welding, submerged arc welding and the like, however, in any method, zone changing microstructure by applied heat during welding (heat affected zone, HAZ) are generated in a weldment. HAZ of a tempered martensitic heat resisting steel shows change in microstructure by exposure to temperatures of $A_{C1}$ point or higher, even if temperature momentarily increases during welding, therefore, there is a problem of decrease in creep strength as compared with a base metal (none heat affected zone). That is, when a creep test is conducted using a welded joint containing a base metal and a weldment as a specimen parallel part, rupture occurs in HAZ.

When a tempered martensitic heat resisting steel is exposed to temperatures of $A_{C1}$ point or higher, ferrite as a base phase of a tempered martensite structure is transformed into austenite. The microstructure of austenite newly generated in this transformation is formed so as to break the microstructure of original tempered martensite. That is, austenite grains generated at temperatures of $A_{C1}$ point or higher nucleate and grow so as to erode the microstructure of ferrite grains, independent of the microstructure of ferrite grains as a base phase of tempered martensite. At temperatures of $A_{C3}$ point or higher, the base phase is utterly transformed to austenite, and the microstructure of original tempered martensite is lost.

Therefore, at temperatures around $A_{C1}$ point to $A_{C3}$ point, austenite grains are newly formed in large amount, as a result, a microstructure with very fine grain size (fine-grained HAZ) is formed. At temperatures around $A_{C3}$ point or higher to melting temperature, austenite grains become coarse, and a microstructure having relatively larger prior austenite grain size (coarse-grained HAZ) as compared with the microstructure of portions exposed to temperatures around $A_{C1}$ point to $A_{C3}$ point.

In commercially available P92, P122 and the like, the prior austenite grain size in a base metal is larger than the prior austenite grain size of a coarse-grained HAZ. That is, in HAZ of P92, P122 and the like normalized at 1090° C. or lower, prior austenite grain size is finer than that of a base metal. As a result to date of investigation of the creep strength of a welded joint of a tempered martensitic heat resisting steel such as P92, P122 and the like, it is known that creep strength decreases remarkably at a fin-grained HAZ. In the case of a welded joint of a tempered martensitic heat resisting steel such as P92, P122 and the like, TYPE-IV fracture at a fine-grained HAZ occurs, and at 650° C., the creep rupture time decreases to about 20% of a base metal.

For suppression of deterioration in creep strength at a fine-grained HAZ, production of Ti, Zr, Hf carbonitride in a base metal is proposed (see, e.g. patent document 1). It is also proposed that one or more kinds of Mg-containing oxide grains having a grain size of 0.002 to 0.1 μm and composite grains having a grain size of 0.005 to 2 μm composed of a Mg-containing oxide and a carbonitride precipitated using the oxide as a nucleus are contained in a total amount of $1\times10^4$ to $1\times10^8/mm^2$ (see, e.g. patent document 2). Further, suppression of deterioration in the creep strength of HAZ by a Ta oxide is proposed (see, e.g. patent document 3). Furthermore, there are proposals such as suppression of deterioration in the creep strength of HAZ by optimization of balance of W and Mo, or by addition of W and by a carbonitride of Nb, Ta (see, e.g. patent documents 4, 5). In addition, suppression of deterioration in the creep strength of HAZ according to solid-solution strengthening of HAZ and improvement in ductility of HAZ by addition of Cu and Ni is proposed (see, e.g. patent document 6).

However, in a creep test of a welded joint of P92, P122 and the like, fracture observed in HAZ, particularly in a fine-grained HAZ is caused by linkage of voids formed at grain boundaries mainly at prior austenite grain boundaries. In view of such fracture mechanism, small size of prior austenite grain is believed to be one of important factors for deterioration in the creep strength of HAZ since small prior austenite grain size increases the number of void nucleation sites and linkage of voids easily occurs.

The present invention has been made in view of the circumstances as described above, and an object of the present invention is to provide a welded joint of a tempered martensitic heat resisting steel in which formation of fine-grained HAZ causing remarkable decrease in creep strength is suppressed.

Patent document 1: Japanese Patent Application Laid-Open (JP-A) No. 08-85848

Patent document 2: JP-A No. 2001-1927761

Patent document 3: JP-A No. 06-65689

Patent document 4: JP-A No. 11-106860

Patent document 5: JP-A No. 09-71845

Patent document 6: JP-A No. 05-43986

SUMMARY OF INVENTION

For solving the above-mentioned problems, at first aspect of the present invention provides a welded joint of a tempered martensitic heat resisting steel, characterized in that a fine-grained HAZ of a weldment of a heat resisting steel having a tempered martensite structure exhibits a creep strength of 90% or more of the creep strength of a base metal.

As preferable embodiments, a second aspect of the present invention provides the welded joint in which the heat resisting steel having a tempered martensite structure contains B in an amount of 0.003 to 0.03%, by weight. A third aspect of the present invention provides the welded joint in which the heat resisting steel having a tempered martensite structure contains one or more of C in an amount of 0.03 to 0.15%, Si in an amount of 0.01 to 0.9%, Mn in an amount of 0.01 to 1.5%, Cr in an amount of 8.0 to 13.0%, Al in an amount of 0.0005 to 0.02%, Mo+W/2 in an amount of 0.1 to 2.0%, V in an amount of 0.05 to 0.5%, N in an amount of 0.06% or less, Nb in an amount of 0.01 to 0.2% and (Ta+Ti+Hf+Zr) in an amount of 0.01 to 0.2%, by weight, and the residue is composed of Fe and inevitable impurities. A fourth aspect of the present invention provides the welded joint in which the heat resisting steel having a tempered martensite structure further contains one or more of Co in an amount of 0.1 to 5.0%, Ni in an amount of 0.5% or less and Cu in an amount of 1.7% or less, by weight. Further, a fifth aspect of the present invention provides the welded joint in which the heat resisting steel having a tempered martensite structure furthermore contains one or more of P in an amount of 0.03% or less, S in an amount of 0.01% or less, 0 in an amount of 0.02% or less, Mg in an amount of 0.01% or less, Ca in an amount of 0.01% or less and Y and rare earth elements in a total amount of 0.01% or less, by weight.

The creep strength referred to in the instant application includes creep rupture strength.

DETAILED DESCRIPTION OF THE INVENTION

In a phenomenon of transformation of ferrite as a base phase into austenite in heating a tempered martensitic heat resisting steel like in welding, if formation of austenite grains is allowed to depend on shape, crystal orientation and the like of ferrite grains as the base phase, a microstructure of austenite formed in heating should be the same or analogous to microstructure of a tempered martensite before welding. In cooling after completion of heating, austenite formed by heating to $A_{C1}$ point or higher is transformed to martensite in a cooling process and its microstructure should be the same or analogous to a tempered martensite structure before welding. It is believed that if formation of austenite grains is thus allowed to depend on shape, crystal orientation and the like of ferrite grains as the base phase, the microstructure of HAZ shows no significant change, and creep strength which is approximately the same as that of a base metal is shown.

Even if, however, formation of austenite grains is allowed to depend on shape, crystal orientation and the like of ferrite grains as the base phase, it is difficult to maintain the same microstructure of the whole region of HAZ as that of the base metal. The reason for this is that in portions exposed to temperatures of $A_{C3}$ point or higher and normalizing temperature or higher of the base metal in welding, there is a possibility that the same austenite microstructure as the tempered martensite microstructure of the base metal is formed, then, austenite grains grow to coarsen.

Figure 1:
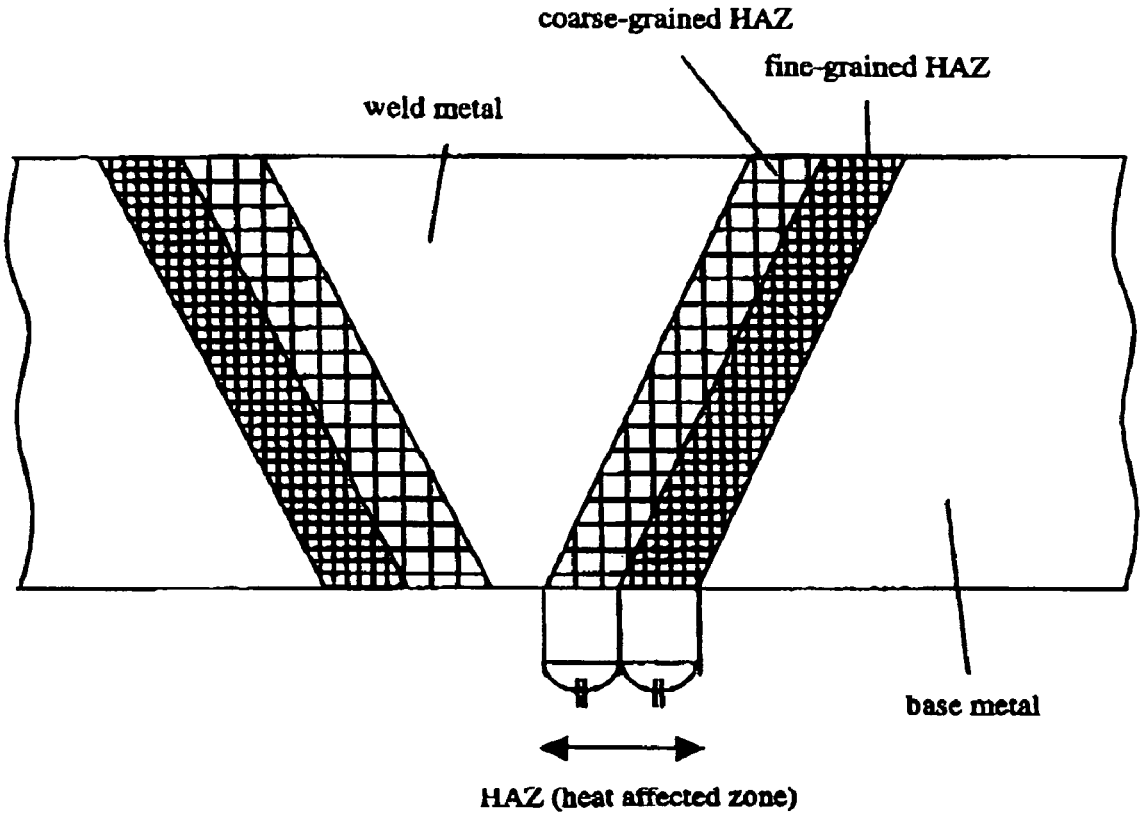
FIG. 1 is view schematically showing a heat affected zone in a welded joint and fine-grained HAZ thereof.

However, as shown in FIG. 1, the fine-grained HAZ fine grain portion occupies a region of approximately half the width of HAZ, and is only exposed to temperatures lower than the normalizing temperature, and therefore, it is believed that the most region corresponding to the fine-grained HAZ can be maintained to have the same microstructure as that of the base metal. Consequently, when formation of austenite grains is allowed to depend on shape, crystal orientation and the like of ferrite grains as the base phase and the most region corresponding to the fine-grained HAZ is maintained the same microstructure as that of the base metal, if HAZ is hypothesized as a region of significant change of microstructure by weld heat input, the width of HAZ should be narrower as compared with a welded joint of a conventional tempered martensitic heat resisting steel, and the creep strength of a welded joint should be improved. Such a decrease in apparent HAZ width is regarded as a disappearance or decrease of conventional fine-grained HAZ.

Further, even if formation of austenite grains is allowed to depend on the shape, crystal orientation and the like of ferrite grains of the base phase, austenite tends to be newly formed without depending on the shape, crystal orientation and the like of ferrite grains of the base phase near prior austenite grain boundary of a tempered martensitic heat resisting steel of the base metal. For this reason, austenite grains not depending on the shape, crystal orientation and the like of ferrite grains of the base phase are partially formed at portions heated to $A_{C1}$ point or higher. However, it is believed that if the amount of such austenite grains is small and the most of austenite grains depend on the shape, crystal orientation and the like of ferrite grains, this corresponds to a decrease of the fine-grained HAZ.

Further, it is also believed that a tempered martensitic heat resisting steel is, in heating, transformed into austenite and simultaneously, austenite grains are recrystallized, fine grain formation being remarkable. Austenite grains formed by the recrystallization grow without depending on the shape, crystal orientation and the like of original tempered martensite structure. Therefore, it is believed that by suppressing formation and growth of austenite grains not depending on original tempered martensite structure, which are thought to be formed by recrystallization, an austenite structure depending on the microstructure of the original base phase can be formed.

The welded joint of a tempered martensitic heat resisting steel of the present invention is prepared based on the above-mentioned theory, and the fine-grained portion in the heat affected zone exhibits a creep strength of 90% or more of the creep strength of the base metal.

Specifically, the chemical composition of a tempered martensitic heat resisting steel used for a welded joint can be selected for realizing the welded joint of a tempered martensitic heat resisting steel of the present invention. For example, by adding of B to a tempered martensitic heat resisting steel, B is segregated on the grain boundary to lower grain boundary energy, therefore, nucleation and growth of nuclei of austenite grains not depending on the crystal orientation of original ferrite grains from the grain boundary of a tempered martensitic heat resisting steel exposed to temperatures of $A_{C1}$ point or higher is suppressed, or nucleation and growth of recrystallized austenite grains is suppressed. As a result, there appears remarkably a phenomenon of transformation into austenite grains depending on the crystal orientation of original ferrite grains.

The content of B is appropriately from 0.003 to 0.03%, by weight. When less than 0.003%, an effect of decreasing grain boundary energy by segregation on grain boundary is not sufficient, and when over 0.03%, toughness and workability are remarkably deteriorated by excess formation of borides. Preferably, the content of B is from 0.004 to 0.02%.

For deriving the above-mentioned effect of B, it is necessary to consider the composition of a tempered martensitic heat resisting steel. The composition of a tempered martensitic heat resisting steel which is effective for allowing formation of austenite grains to depend on the shape, crystal orientation and the like of ferrite grains of the base phase is exemplified below.

The content of N is appropriately 0.06% or less, by weight. N forms a nitride with Nb or V to contribute to creep strength, however when the content of N is over 0.06%, the amount of BN as a nitride with B increases, consequently, the effect of B added lowers remarkably, and weldability also decreases. When the prior austenite grain size in the base material is increased, the content of N is preferably 0.01% or less though it depends on the addition amount of B.

The content of C is appropriately from 0.03 to 0.15%, by weight. C is an austenite stabilization element, stabilizes the microstructure of tempered martensite, and forms a carbide to contribute to creep strength. When less than 0.03%, precipitation of a carbide is small and sufficient creep strength is not obtained. On the other hand, when over 0.15%, remarkable hardening that lower workability and toughness occurs in a process of forming the microstructure of tempered martensite. The content of C is appropriately from 0.05 to 0.12%.

The content of Si is appropriately from 0.01 to 0.9%, by weight. Si is an important element for ensuring oxidation resistance and operates as a deoxidizer in a steel making process. When the content is less than 0.01%, sufficient oxidation resistance cannot be obtained, and when over 0.9%, toughness lowers. Preferably, the Si content is 0.1 to 0.6%.

The content of Mn is appropriately from 0.01 to 1.5%, by weight. Mn operates as a deoxidizer in a steel making process and is an important additional element from the standpoint of decreasing Al used as a deoxidizer. When the content is less than 0.01%, sufficient deoxidation function cannot be obtained, and when over 1.5%, creep strength remarkably lowers. The content of Mn is preferably from 0.2 to 0.8%.

The content of Cr is appropriately from 8.0 to 13.0%, by weight. Cr is an element indispensable for ensuring oxidation resistance. When the content is less than 8.0%, sufficient oxidation resistance cannot be obtained, and when over 13.0%, the precipitation amount of δ-ferrite increases to remarkably lower creep strength and toughness. Preferably, the Cr content is from 8.0 to 10.5%.

The content of Al is appropriately from 0.0005 to 0.02%, by weight. Al is an important element as a deoxidizer, and it is necessary that Al is contained in an amount of 0.0005% or more. When over 0.02%, creep strength remarkably decreases.

For the content of Mo and W, the Mo equivalent (Mo+W/2) is appropriately from 0.1 to 2.0%, by weight. Mo and W are solid-solution strengthening elements and form a carbide to contribute to creep strength. For manifesting a solid-solution strengthening effect, a content of at least 0.1% is necessary. On the other hand, when over 2.0%, precipitation of an intermetallic compound is promoted, and creep strength and toughness remarkably lower. Preferably, the content of Mo+W/2 is from 0.3 to 1.7%.

The content of V is appropriately from 0.05 to 0.5%, by weight. V forms a fine carbonitride to contribute to creep strength. When less than 0.05%, precipitation of a carbonitride is small and sufficient creep strength is not obtained. On the other hand, when over 0.5%, toughness is remarkably deteriorated.

The content of Nb is appropriately from 0.01 to 0.2%, by weight. Nb forms, like V, a fine carbonitride to contribute to creep strength. When less than 0.01%, precipitation of a carbonitride is small and sufficient creep strength is not obtained. On the other hand, when over 0.2%, toughness is remarkably deteriorated.

Ta, Ti, Hf and Zr form, like Nb and V, a fine carbonitride to contribute to creep strength. When Nb is not added, sufficient creep strength is not obtained unless Ta, Ti, Hf and Zr are added in a total amount of 0.01% or more. When Nb is added, Ta, Ti, Hf and Zr are not necessarily added. When the total content is over 0.2%, toughness lowers.

The content of Co is appropriately from 0.1 to 5.0%, by weight. It is necessary that Co is added in an amount of 0.1% or more for suppressing production of δ-ferrite and easily forming the microstructure of tempered martensite. However, when over 5.0%, not only creep strength decreases but also economy deteriorates since Co is an expensive element. Preferably, the content of Co is from 0.5 to 3.5%.

Ni and Cu are both austenite stabilizing elements, and one or two of them can be added to suppress production of δ-ferrite and to improve toughness. However, when Ni is added in an amount of over 0.5% or when Cu is added in an amount of over 1.7%, by weight, creep strength lowers remarkably.

P, S, O, Mg, Ca, Y and rare earth elements are all inevitable impurities, and lower content is more preferable. When P is over 0.03%, S is over 0.01%, 0 is over 0.02%, Mg is over 0.01%, Ca is over 0.01%, or Y and rare earth elements is over 0.01%, creep ductility lowers.

In a tempered martensitic steel in the welded joint of a tempered martensitic steel of the present invention, it is possible that one or more of the above-mentioned elements are contained in each predetermined amount and the residue is composed of Fe and inevitable impurities. The inevitable impurities include Sn, As, Sb, Se and the like, and these elements tend to be segregated on grain boundary. In a preparing process, there is a possibility of mixing of a component which is liable to promote void formation during creep. It is preferable that the content of such impurity elements is decreased as low as possible.

According to the present invention, a welded joint in which a fine-grained HAZ causing remarkable decrease in creep strength is suppressed is realized. Reliability of a heat resistant and pressure resistance weld component used in the field of boiler and turbine for power generation, atomic power generation equipment, chemical industry and the like is improved, and use at high temperature for long term becomes possible, and equipments with higher efficiency are realized, in addition to elongation of life in various plants and decrease in production cost and running cost.

The welded joint of a tempered martensitic steel of the present invention will be explained further in detail by the following examples.

EXAMPLES

TABLE 1

| | C | Si | Mn | P | S | Cr | W | Mo | V | Nb | Co |
|---|---|---|---|---|---|---|---|---|---|---|---|
| P1 | 0.079 | 0.30 | 0.48 | <0.001 | <0.001 | 8.77 | 2.93 | <0.01 | 0.18 | 0.046 | 2.91 |
| P2 | 0.074 | 0.30 | 0.48 | <0.001 | 0.001 | 8.93 | 3.13 | <0.01 | 0.18 | 0.046 | 2.92 |
| T1 | 0.078 | 0.30 | 0.50 | 0.002 | 0.002 | 9.27 | 1.01 | 0.98 | 0.21 | 0.047 | 1.54 |
| T2 | 0.078 | 0.31 | 0.50 | 0.002 | 0.002 | 9.28 | 1.61 | 0.72 | 0.20 | 0.030 | 2.01 |
| T3 | 0.079 | 0.30 | 0.50 | 0.002 | 0.002 | 9.27 | 2.01 | 0.49 | 0.21 | 0.048 | 3.03 |

TABLE 1-continued

| | C | Si | Mn | P | S | Cr | W | Mo | V | Nb | Co |
|---|---|---|---|---|---|---|---|---|---|---|---|
| S1B | 0.12 | 0.28 | 0.61 | 0.018 | 0.001 | 10.05 | 2.05 | 0.36 | 0.21 | 0.06 | — |
| S2 | 0.09 | 0.16 | 0.47 | 0.010 | 0.001 | 8.72 | 1.87 | 0.45 | 0.21 | 0.06 | — |
| | N | B | Sol.Al | others | | | shape | heat treatment | | | |
| P1 | 0.0017 | 0.0047 | <0.001 | O:0.002 Ni < 0.01 | | | plate | 1080° C.-1 h AC → 800° C.-1 h AC | | | |
| P2 | 0.0014 | 0.0090 | 0.001 | O:0.002 Ni < 0.01 | | | plate | 1080° C.-1 h AC → 800° C.-1 h AC | | | |
| T1 | 0.0017 | 0.0130 | 0.002 | | | | tube | 1150° C.-1 h AC → 800° C.-1 h AC | | | |
| T2 | 0.0075 | 0.0130 | 0.002 | Ta:0.04 Ni:0.2 Cu:0.05 | | | tube | 1080° C.-1 h AC → 800° C.-1 h AC | | | |
| T3 | 0.0029 | 0.0095 | 0.002 | | | | tube | 1150° C.-1 h AC → 790° C.-1 h AC | | | |
| S1B | 0.059 | 0.003 | 0.017 | Ni:0.3 Cu:0.97 | | | plate | 1050° C.-1.6 h AC → 770° C.-3 h AC | | | |
| S2 | 0.050 | 0.002 | — | | | | plate | 1070° C.-h AC → 780° C.-1 h AC | | | |

Mg < 0.01%,
Ca < 0.01%,
Y and rare earth elements < 0.01%

Table 1 shows the composition, shape and heat treatment of materials used in preparation of a welded joint and a test for confirming the microstructure of HAZ. P1, P2 materials and T1 to T3 materials were prepared from 180 kg of ingot using a vacuum melting furnace. P1, P2 materials were molded into a plate having a thickness of 30 mm by hot forging, and heat treatments as shown in Table 1 were performed. T1 to T3 materials were molded into a steel tube having an outer diameter of 84 mm and a wall thickness of 12.5 mm by hot extrusion, and heat treatments as shown in Table 1 were performed. S1B is ASME P122 material, and heat treatment is as shown in Table 1. S2 is a commercially available material corresponding to a conventional material, ASME P92 material, and heat treatment is as shown in Table 1.

Regarding P1, P2 materials, T1 to T3 materials, S1B material and S2 material, welded joints were prepared by joining the same materials. Welded joints were all prepared according to a gas-tungsten-arc welding method, and the welding conditions included a voltage of 10 to 15V, a current of 100 to 200 A, an Ar shield gas, and a post weld heat treatment at 740° C. for 4 hours. Regarding the welding consumables, AWS ER Ni Cr-3 material was used for welded joints of P1, P2 materials and T1 to T3 materials, and welding consumables with matching composition were used for welded joints of S1B material and S2 material. Regions in which the fine-grained HAZ fine of these welded joints depended on the shape and crystal orientation of ferrite grains in the microstructure of tempered martensite of the base metal were measured. In this measurement, as shown in FIG. 1, the fine-grained HAZ was defined as a portion of base metal side among portions obtained by bisecting HAZ from weld metal to base metal side. The HAZ width was defined as a length from a portion softened by heat-affection as compared with the hardness of the base metal to weld metal, according to measurement using a micro Vickers hardness machine. The welded joint showing unclear softening was etched in optical microscope observation, and the width of a region manifesting stronger fogging than that of the base metal was visually measured. Specifically, a cross-section was cut at HAZ of a welded joint, mirror-like polished, then, etched, and the area of a region depending on the shape and crystal orientation of ferrite grains of the tempered martensite structure of the base metal was measured by an optical microscope.

TABLE 2

| | Base metal of welded joint | Area ratio of microstructure depending on the microstructure of base metal |
|---|---|---|
| Present invention | P1 | 85% |
| | P2 | 85% |
| | T1 | 90% |
| | T2 | 75% |
| | T3 | 85% |
| Conventional materials | S1B | 0% |
| | S2 | 0% |

Table 2 shows the area ratio of a region depending on the shape and crystal orientation of ferrite grains of the microstructure of the base metal at the fine-grained HAZ of a welded joint. In P1, P2 materials and T1 to T3 materials, the area ratio was 75% or more. From this, it is understood that most of the microstructure of fine-grained HAZ has the same prior austenite grain size as that of the base metal and is not a fine-grained HAZ composed of fine prior austenite grains like conventional tempered martensitic heat resisting steel. On the other hand, the fine-grained HAZ of conventional materials, S1B material and S2 material, were all occupied with fine prior austenite grains.

In measurement of a region depending on the shape and crystal orientation of ferrite grains of tempered martensite structure of the base metal, it was taken into consideration that in the case of an adjacent region having the same crystal orientation, the concentration, pattern and the like of etching were the same, that when exposure temperature and time of the fine-grained HAZ are considered, the size of austenite grains grown by recrystallization is relatively small, and that regions excepting the austenite grains formed by recrystallization were regions transformed depending on the orientation and the like of original ferrite grains.

Welded joints of P1, P2 materials and T1 to T3 materials were subjected to a creep test. In the creep test, the temperature was 650° C. and the applied stress was 100, 110, 120 or 130 MPa. At 100 MPa, rupture occurred at the boundary of weld metal, at 110 MPa or higher, rupture occurred at the base metal in all welded joints and excellent creep strength of the fine-grained HAZ was confirmed. On the other hand, as a result of the creep test on welded joints of S1B material and S2 material of conventional tempered martensitic heat resisting steels (temperature: 650° C., applied stress: 110, 90 MPa), it was confirmed that rupture occurred at the fine-grained HAZ, and the fine-grained HAZ had a creep strength lower than the of the base metal.

The creep rupture time at 650° C. and 110 MPa was 1930 hours for the welded joint of P2 material, 1300 hours for the base metal of S1B material, and 950 hours for the welded joint of S1B material. The welded joint of P2 material showed excellent creep strength.

Figure 2:
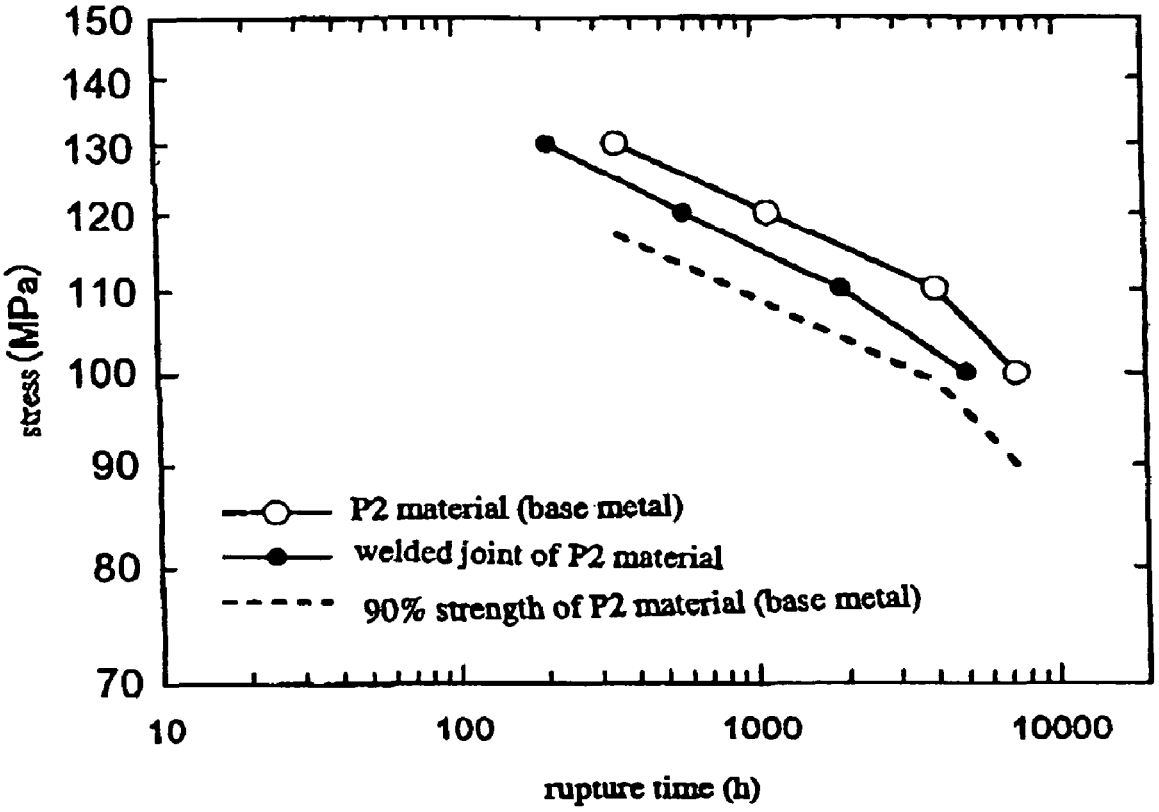
FIG. 2 is a correlation diagram showing the relation between stress and rupture time in a creep test at 650° C. of a welded joint and base metal of a P2 material.

FIG. 2 shows the relation of stress and rupture time in a creep test at 650° C. of a welded joint and base metal of P2 material and P2 material.

In FIG. 2, the creep strength of the welded joint of P2 material is higher than a dot line corresponding to 90% of the creep strength of P2 material, clearly confirming that it is 90% or higher of the creep strength of the base metal. Likewise, the creep strength at 650° C. of the welded joint of the present invention was 90% or higher of the creep strength of the base metal.

On the other hand, the creep strengths at 650° C. of the welded joints of S1B material and S2 material were both less than 90% of the creep strength of the base metal at lower stresses of 90 MPa or lower.

From the above-mentioned results, it was confirmed that the welded joint of a tempered martensitic heat resisting steel of the present invention has a larger area ratio of a region depending on the shape and crystal orientation of ferrite grains in the tempered martensite structure of the base metal in the fine-grained HAZ and that the creep strength of the fine-grained HAZ is 90% or more of the creep strength of the base metal.

Next, pieces of about 10 mm×10 mm×20 mm were cut out from P2 material, T2 material, S1B material and S2 material, and kept for 1 hour at 950° C. which is a temperature condition to which a portion formed a fine-grained HAZ is exposed during welding, air-cooled, then, subjected to post weld heat treatment (740° C. for 4 hours, then, air-cooled). The stability of a microstructure depending on the microstructure of the base metal can be evaluated by performing such a heat treatment and measuring the area ratio of a region depending on the shape and crystal orientation of ferrite grains in the tempered martensite structure of the base metal. Usually, the heat history to form the microstructure of HAZ is that in which temperature reaches to the peak temperature with raising speed of several tens to 100 K/second, the peak temperature was kept for an extremely short time of about several seconds or shorter or without keeping the temperature, and subsequently the temperature returns to about 100 to 300° C. with decreasing speed of about several tens K/second. From this, it is believed that the microstructure formed by the above-mentioned heat treatment at 950° C. for 1 hour contains many microstructures not depending on the microstructure of the base metal since the keeping time is longer than that exposed in actual welding. The temperature raising speed of the heat treatment at 950° C. for 1 hour was 20° C./minutes. All the samples had a $A_{C3}$ point of 950° C. or lower.

TABLE 3

| | Base metal of welded joint | Area ratio of microstructure depending on the microstructure of base metal |
|---|---|---|
| Present invention | P2 | 60% |
| | T2 | 60% |
| Conventional materials | S1B | 0% |
| | S2 | 0% |

Table 3 shows the area ratio of a microstructure depending on the microstructure of the base metal in each sample subjected to the heat treatment at 950° C. for 1 hour. S1B material and S2 material have utterly no microstructure depending on the microstructure of the base metal, on the other hand, P2 material and T2 material have 60% of microstructures depending on the microstructure of the base metal, indicating the same result as for the fine-grained HAZ of a welded joint.

It is needless to say that the present invention is not limited to the above-mentioned examples and various modifications are possible in detailed points.

INDUSTRIAL APPLICABILITY

As described in detail above, a welded joint of a tempered martensitic heat resisting steel in which a fine-grained HAZ causing remarkable decrease in creep strength is suppressed is realized by the present invention.

The invention claimed is:

1. A welded joint of a tempered martensitic heat resisting steel, wherein the heat resisting steel having a tempered martensite structure consists of the following elements by weight %, C: 0.03 to 0.15%,
Si: 0.01 to 0.9%,
Mn: 0.01 to 1.5%,
Cr: 8.0 to 13.0%,
Al: 0.0005 to 0.02%,
Mo+W/2: 0.1 to 2.0%,
V: 0.05 to 0.5%,
N: 0.06% or less,
Nb: 0.01 to 0.2%,
B: 0.003 to 0.03%,
Co: 0.1 to 5.0%, and
the residue is composed of Fe and the following inevitable impurities by weight %,
P: 0.03% or less,
S: 0.01% or less,
O: 0.02% or less,
Mg: 0.01% or less,
Ca: 0.01% or less, and
Y and rare earth elements: a total amount of 0.01% or less,
and wherein an area ratio of a microstructure depending on a microstructure of a base metal is 60% or more in a heat affected zone, and formation of fine prior austenite grains is suppressed in the heat affected zone.

2. A welded joint of a tempered martensitic heat resisting steel, wherein the heat resisting steel having a tempered martensite structure consists of the following elements by weight %, C: 0.03 to 0.15%,
Si: 0.01 to 0.9%,
Mn: 0.01 to 1.5%,
Cr: 8.0 to 13.0%,
Al: 0.0005 to 0.02%,
Mo+W/2: 0.1 to 2.0%,
V: 0.05 to 0.5%,
N: 0.06% or less,
Nb: 0.01 to 0.2%,
B: 0.003 to 0.03%,
Co: 0.1 to 5.0%,
Ni: 0.5% or less,
Cu: 1.7% or less, and
the residue is composed of Fe and the following inevitable impurities by weight %, P: 0.03% or less,
S: 0.01% or less,
O: 0.02% or less,
Mg: 0.01% or less,
Ca: 0.01% or less, and
Y and rare earth elements: a total amount of 0.01% or less, and wherein an area ratio of a microstructure depending on a microstructure of a base metal is 60% or more in a heat affected zone, and formation of fine prior austenite grains is suppressed in the heat affected zone.

* * * * *